US007063146B2

(12) United States Patent
Schultz et al.

(10) Patent No.: US 7,063,146 B2
(45) Date of Patent: Jun. 20, 2006

(54) SYSTEM AND METHOD FOR PROCESSING SIGNALS IN A WELL

(75) Inventors: Roger L. Schultz, Aubrey, TX (US); Michael L. Fripp, Carrollton, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 273 days.

(21) Appl. No.: 10/692,711

(22) Filed: Oct. 24, 2003

(65) Prior Publication Data

US 2005/0087339 A1 Apr. 28, 2005

(51) Int. Cl.
*E21B 47/10* (2006.01)
*E21B 47/12* (2006.01)

(52) U.S. Cl. ..... 166/250.08; 166/65.1; 166/66

(58) Field of Classification Search ..... 166/66, 166/65.1, 250.08; 340/853.2, 856.3, 856.4, 340/856.2

See application file for complete search history.

(56) References Cited

U.S. PATENT DOCUMENTS

| | | | | |
|---|---|---|---|---|
| 3,412,790 | A | 11/1968 | Brown | 166/4 |
| 4,067,349 | A | 1/1978 | Austin et al. | 138/97 |
| 4,206,810 | A | 6/1980 | Blackman | 166/336 |
| 4,426,882 | A | 1/1984 | Skinner | 73/155 |
| 4,506,731 | A | 3/1985 | Skinner | 166/113 |
| 4,508,174 | A | 4/1985 | Skinner et al. | 166/373 |
| 4,582,136 | A | 4/1986 | Skinner | 166/250 |
| 4,866,607 | A | 9/1989 | Anderson et al. | 364/422 |
| 4,999,817 | A | 3/1991 | Zimmer | 367/65 |
| 5,234,057 | A | 8/1993 | Schultz et al. | 166/319 |
| 5,236,048 | A | 8/1993 | Skinner et al. | 166/382 |
| 5,273,113 | A | 12/1993 | Schultz | 166/250 |
| 5,279,363 | A | 1/1994 | Schultz et al. | 166/53 |
| 5,293,937 | A | 3/1994 | Schultz et al. | 166/250 |
| 5,318,137 | A | 6/1994 | Johnson et al. | 175/40 |
| 5,332,035 | A | 7/1994 | Schultz et al. | 166/53 |
| 5,343,963 | A | 9/1994 | Bouldin et al. | 175/27 |
| 5,355,960 | A | 10/1994 | Schultz et al. | 166/374 |
| 5,367,911 | A | 11/1994 | Jewell et al. | 73/861.08 |
| 5,412,568 | A | 5/1995 | Schultz | 364/422 |
| 5,490,564 | A | 2/1996 | Schultz et al. | 166/374 |
| 5,712,912 | A | 1/1998 | Tomko et al. | 380/23 |
| 5,730,219 | A | 3/1998 | Tubel et al. | 66/250.01 |
| 5,899,958 | A | 5/1999 | Dowell et al. | 702/6 |
| 5,918,669 | A | 7/1999 | Morris et al. | 166/50 |
| 6,041,860 | A | 3/2000 | Nazzal et al. | 166/250.01 |
| 6,050,131 | A | 4/2000 | Willauer | 73/37 |
| 6,070,672 | A | 6/2000 | Gazda | 166/386 |
| 6,131,658 | A | 10/2000 | Minear | 166/250.01 |
| 6,144,316 | A | 11/2000 | Skinner | 340/853.7 |

(Continued)

OTHER PUBLICATIONS

U.S. Appl. No. 10/251,160, filed Sep. 20, 2002, entitled "System and Method for Sensing Leakage Across a Packer" by Roger L. Schultz et al.

*Primary Examiner*—Hoang Dang
(74) *Attorney, Agent, or Firm*—John W. Wustenberg; Haynes & Boone, LLP

(57) ABSTRACT

A system and method for transferring data across a component in a well, according to which a first module receives the data and transmits the data, via electromagnetic waves, through the component, and a second module receives the transmitted data from the first module.

15 Claims, 1 Drawing Sheet

U.S. PATENT DOCUMENTS 6,229,453 B1 5/2001 Gardner et al. ..... 340/853.8
6,233,746 B1 5/2001 Skinner ..... 2/227.18
6,236,620 B1 5/2001 Schultz et al. ..... 367/82
6,257,332 B1 7/2001 Vidrine et al. ..... 166/250.15
6,273,189 B1 8/2001 Gissler et al. ..... 166/241.1
6,286,596 B1 9/2001 Schnatzmeyer et al. ..... 166/250.15
6,310,559 B1 10/2001 Laborde et al. ..... 340/853.2
6,321,838 B1 11/2001 Skinner ..... 166/250.01
6,328,119 B1 12/2001 Gillis et al. ..... 175/325.1
6,343,649 B1 * 2/2002 Beck et al. ..... 166/250.01
6,384,738 B1 5/2002 Carstensen et al. ..... 340/854.3
6,394,181 B1 5/2002 Schnatzmeyer et al. ..... 166/250.15
6,513,596 B1 * 2/2003 Wester ..... 166/336
2001/0013410 A1 8/2001 Beck et al. ..... 166/65.1
2001/0013411 A1 8/2001 Beck et al. ..... 166/65.1
2001/0040033 A1 11/2001 Schnatzmeyer et al. ..... 166/250.15
2001/0042617 A1 11/2001 Beck et al. ..... 166/65.1
2001/0043146 A1 11/2001 Beck et al. ..... 340/855.8
2004/0200613 A1 * 10/2004 Fripp et al. ..... 166/250.01

* cited by examiner

SYSTEM AND METHOD FOR PROCESSING SIGNALS IN A WELL

BACKGROUND

This invention relates to a system and method for processing signals in a well, and, more particularly, for acquiring signals and transmitting the signals across, or through, a component located downhole in a well.

It is often desirable to provide one or more electronic data sources, such as sensors, actuators, control systems, and the like, on or near a component in a tubing string that is inserted in a well penetrating a subterranean formation for the purpose of recovering oil and/or gas from the formation. For example, the data source could be in the form of a sensor to sense leakage across a packer, or other sealing device, deployed in the well for the purpose of isolating one or more portions of the well for testing, treating, or producing the well.

However, to utilize a data source in the above manner, it is usually necessary to run electrical cables from the data source under or through the component, which often causes problems. For example, the cables take up valuable space and, if the component is a packer, the cables could create a fluid leakage path through the packer.

Therefore, what is needed is a system and method which permits the transmission of data across or through a component in a well, while eliminating the need for electrical cables.

DETAILED DESCRIPTION

Figure 1:
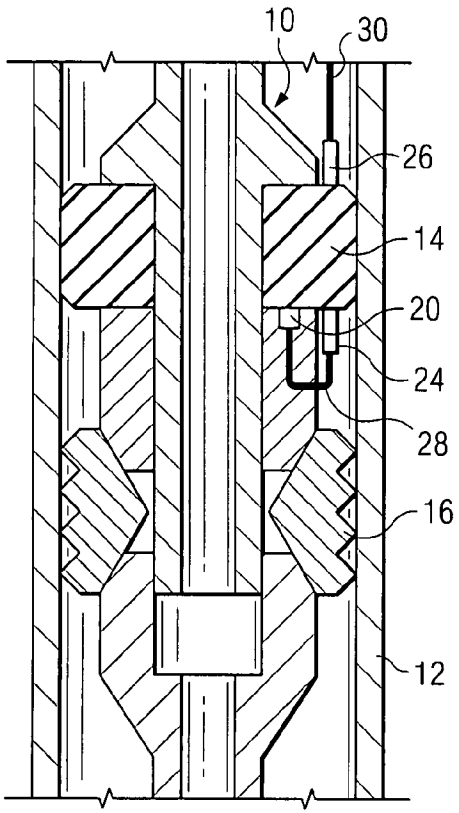
FIG. 1 is a partial sectional, partial diagrammatic, view of an embodiment of the present invention.

Referring to FIG. 1 of the drawing, a downhole tool is referred to, in general, by the reference numeral 10 and is shown installed in a casing 12 disposed in a well. The tool 10 is lowered to a predetermined depth in the casing 12 as part of a tubing string, or the like, (not shown) which often includes other tools used to perform various oil recovery and completion operations. Since the tool 10 is conventional, it will not be described in detail.

The tool 10 includes a packer 14 and an annular slip 16 located downstream, and axially spaced, from the packer 14. The packer 14 is located at a predetermined axial location in the casing 12 and is set, or activated, in a conventional manner which causes it to engage the inner surface of the casing 12 to seal against the flow of fluids and thus permit the isolation of certain zones in the well. The slip 16 functions to engage, or grip, the inner wall of the casing 12 and since it and the packer 14 are conventional, they will not be described in further detail.

A data source 20 is mounted on the lower surface of the packer 14, as viewed in the drawing, and is attached, or secured, to the packer 14 in any conventional manner. The data source 20 can be in the form of a sensor, an actuator, a control unit, or other type of device that is used in connection with the packer 14 for various operations, and is adapted to output a corresponding signal. For example, the data source 20 can be in the form of a sensor for sensing a condition or function of the packer 14, such as fluid leakage across the packer 14, and outputting a corresponding signal, as disclosed in assignee's copending patent application Ser. No. 10/251,160, filed Sep. 20, 2002, the disclosure of which is incorporated herein by reference in its entirety.

A wireless electronic transmitter module 24 is mounted on the lower surface of the packer 14, as viewed in the drawing and is adapted to broadcast, or transmit electrical signals. The transmitter module 24 can be in the form of an acoustic source such as a solid state transducer formed by a piezoelectric, ferroelectric, or magnetostrictive material, or it can be in the form of an electroactive polymer, or a voice coil.

An electronic receiver module 26 is mounted on the upper surface of the packer 14 and may be in the form of a solid-state transducer formed by a piezoelectric, ferroelectric, or magnetostrictive material or it can be in the form of an accelerometer, microphone, foil strain gage, or a voice coil. Thus, signals emitted by the transmitter module 24 can be received by the receiver module 26 without the use of conductors, cables, or wires.

A data communication cable 28 extends between, and is electrically connected to, the data source 20 and the transmitter module 24. One end of a data communication cable 30 is electrically connected to the receiver module 26 and extends uphole to equipment disposed on the ground surface, as disclosed in the above-identified patent application. Each data communication cable 28 and 30 contains at least one electrical conductor for conducting electrical signals in a manner to be discussed.

It is understood that the data source 20 and the modules 24 and 26 are normally provided with power sources (not shown). Alternately, one of the modules 24 or 26 can deliver power to the other module, by inductive coupling at a frequency other than the transmission frequency, while simultaneously sending or receiving data. This eliminates the need for a power source for the other module. Also, a power source for the data source 20 can be eliminated and the data source 20 can receive power from the transmitter module 24 and/or the receiver module 26 in the above manner.

In operation, and assuming that the data source 20 is in the form of a sensor that senses data downhole, such as leakage across the packer 14, such data are outputted to the transmitter module 24 via the data communication cable 28. The transmitter module 24 creates corresponding high frequency oscillations in the manner discussed above that propagate, either singly or in combination, through the packer 14. The receiver module 26 receives and measures the encoded signals and converts them back into electrical impulses which are transmitted, via the data communication cable 30, to ancillary equipment (not shown) at the ground surface. This auxiliary equipment processes the signal outputted from the receiver module 26 and performs additional functions such as, for example, adjusting the packer 14 to eliminate the above leakage.

The communication path between the modules 24 and 26 can be tuned to find a preferred frequency range for transmission. In general, the tool 10, including the packer 14 and the slip 16, will have different attenuation at different frequencies and it is preferred to send the signals from the transmitter module 24 to the receiver module 26 at the frequencies that have lower attenuation. These frequencies can be chosen, a priori based upon numerical modeling, based upon previous experience, or they can be adjusted in the well based upon measured parameters. Also, the frequencies can be remotely adjusted by using a neural network algorithm or by using an adaptive feedforward algorithm.

The attenuation at different frequencies can be measured by having the transmitter module 24 send a signal and then listen for the reflected frequencies. Alternatively, the transmitter module 24 could send signals and it, or a receiver placed adjacent to it, could be set to listen for the rebroadcast of the signals by the receiver module 26, or a transmitter placed adjacent to the latter module. In the latter case the frequencies that are returned to the transmitter module 24 would be the preferred frequencies for transmission between the modules 24 and 26.

Figure 2:
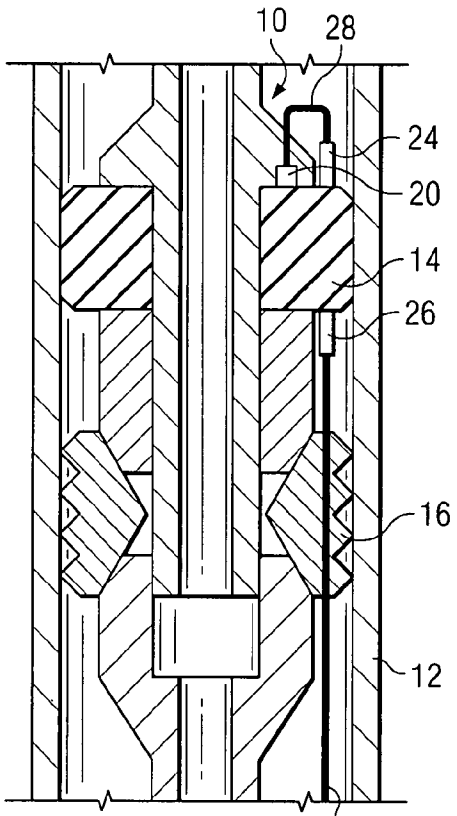

The embodiment of FIG. 2 is similar to that of FIG. 1 and identical components are given the same reference numerals. According to the embodiment of FIG. 2, the data source 20 is mounted on the upper portion of the packer 14. The data communication cable 28 extends between, and is electrically connected to, the data source 20 and the transmitter module 24; and one end of the data communication cable 30 is electrically connected to the receiver module 26 and extends downhole to equipment (not shown) for processing the signal outputted from the receiver module 26, as disclosed in the above-identified patent application. Otherwise the embodiment of FIG. 2 is identical to that of FIG. 1.

Figure 3:
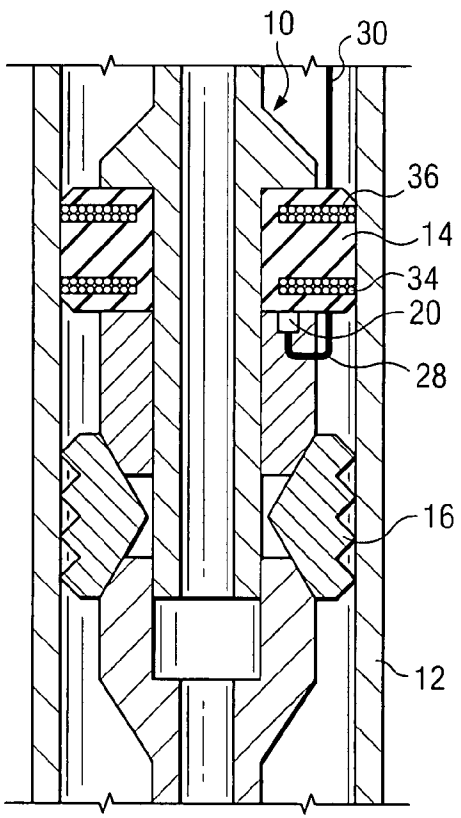
FIGS. 2 and 3 are similar to FIG. 1 but depict alternate embodiments of the present invention.

The embodiment of FIG. 3 is similar to that of FIG. 1 and identical components are given the same reference numerals. According to the embodiment of FIG. 3, the modules 24 and 26 of the embodiment of FIG. 1 are replaced by two inductive coils 34 and 36, respectively. The coil 34 is wrapped around the lower portion of the packer 14 and is connected to one end of the data communication cable 28; while the coil 36 is wrapped around the upper portion of the packer 14 and is connected to one end of the data communication cable 30. The other end of the data communication cable 28 is connected to the data source 20, and the data communication cable 30 extends to equipment at the ground surface for the reasons described in connection with the embodiment of FIG. 1.

Thus, in the embodiment of FIG. 3, the coil 34 receives the signal from the data source 20 corresponding to the sensed data, which, in the above example, is the leakage across the packer 14, and transmits corresponding data to the coil 36 which functions as a receiver and, as such, receives the data from the coil 34 and passes it to the data communication cable 30 for transmission to the ground surface.

The elements of the packer 14 can include a ferromagnetic material in order to facilitate inductive coupling of the coils 34 and 36. For example, a standard packer rubber could incorporate a metallic element (such as nickel, steel, iron, cobalt, dysprosium, or gadolinium powder) or a ceramic element in order to increase the coupling between the coils 34 and 36. The ferromagnetic materials could be incorporated into the formation of the packer 14 as a powder, rod, or mesh. The steel mandrel of the packer 14 could also serve to improve the connection between the coils 34 and 36.

It is understood that the embodiment of FIG. 3 can be adapted to function in the same manner as the embodiment of FIG. 2, i.e., the data source 20 can be mounted on the upper surface of the packer 14 and connected, via the data communication cable 28, to the coil 36 which receives the output of the source 20 and transmits corresponding signals to the coil 34. The data communication cable 30 would then transmit corresponding signals from the coil 34 downhole to equipment for further processing.

Thus, each of the above embodiments permits a wireless, non-evasive transmission of data across a downhole component, in an efficient, low-cost manner.

VARIATIONS AND EQUIVALENTS

It is understood that several variations may be made in the foregoing without departing from the scope of the invention.

1. A primary or rechargeable battery could be incorporated with the modules 24 and/or 26.

2. A power generator could be provided in the wellbore or the casing 12 to convert hydraulic power from the fluid flow in the wellbore to electrical power to drive the data source 20 and/or the modules 24 and 26. This downhole power generator could have a rechargeable battery to provide power at times when there is no flow.

3. The data source 20 can be replaced with another data source such as a hard-wired umbilical or a downhole electronics module, a source disclosed in the above-identified application, or any other source.

4. The signals can be transmitted between the modules 24 and 26 by electromagnetic waves rather than acoustically as described above.

5. The signals can be transmitted across, or through, any other conventional component, other than a packer, located downhole.

6. The data source 20 could be mounted on any surface of the component or packer 14, or embedded in or adjacent to, the component or packer.

7. If the component is a packer, the modules 24 and 26 could be mounted on the outer edge of the packer, within its shoe, setting sleeve, and/or retainer, and/or on the slip 16.

8. The number of data sources 20 and modules 24 and 26 can be varied. For example an array of transmitter modules 24 could be used to direct the transmission towards an array of receiver modules 26 which could be designed to preferentially sense the transmissions coming from the transmitter modules 24.

9. The location of the modules 24 and 26 can be varied. For example, both modules 24 and 26 can be located above the component, or packer, in which case the data source 20 would be located below the component. In this case the data source 20 would function to change the impedance of the casing 12 in one of several ways so that different amounts of energy are reflected which would reduce the power requirement at the downhole location. Also, the electrical impedance could be changed by connecting/disconnecting the casing 12 with the tool 10. Further, the magnetic impedance could be changed in the magnetic flux return path, such as through the casing 12. Still further, the acoustic impedance could be changed by grabbing the casing 12 by energizing a magnetorheological fluid or an electrorheological fluid.

It is understood that spatial references, such as "upper", "lower", "inner", "outer", etc., as used above are for the purpose of illustration only and do not limit the specific spatial orientation or location of the components described above.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims.

What is claimed is:

1. A system for processing signals in a well, comprising:

a packer disposed in the well;

a data source disposed in the well for acquiring data relating to fluid leakage across the packer;

a wireless electronic transmitter disposed in the well and connected to the data source for receiving signals from the data source and transmitting corresponding signals through the packer; and a receiver disposed in the well for receiving the corresponding signals from the transmitter after transmission through the packer.

2. The system of claim 1 further comprising an electrical conductor connected to the receiver for passing the corresponding signals from the receiver uphole or downhole.

3. The system of claim 1 wherein the corresponding signals are transmitted via electromagnetic waves.

4. The system of claim 1 wherein the corresponding signals are transmitted acoustically.

5. The system of claim 1 wherein the transmitter and/or receiver are mounted on, or adjacent to, the packer.

6. The system of claim 1 wherein the transmitter and/or receiver are embedded in the packer.

7. A method for processing signals in a well, comprising the steps of:

acquiring data in the well relating to fluid leakage across a packer in the well;

transmitting signals corresponding to the data through the packer;

receiving the corresponding signals after transmission through the packer; and conducting the corresponding signals from the receiver.

8. The method of claim 7 wherein the signals corresponding to the data are transmitted via electromagnetic waves.

9. The method of claim 7 wherein the signals corresponding to the data are transmitted acoustically.

10. A system for processing signals in a well, comprising:

a packer disposed in the well;

means disposed in the well for acquiring data relating to the fluid leakage across the packer;

transmitter means for receiving signals from the means and transmitting corresponding signals through the packer; and receiver means disposed in the well for receiving the corresponding signals after transmission through the packer.

11. The system of claim 10 further comprising means connected to the receiver means for passing the corresponding signals from the receiver means uphole or downhole.

12. The system of claim 10 wherein the data is transmitted via electromagnetic waves.

13. The system of claim 10 wherein the data is transmitted acoustically.

14. The system of claim 10 wherein the transmitter means and/or the receiver means are mounted on, or adjacent to, the packer.

15. The system of claim 10 wherein the transmitter means and/or the receiver means are embedded in the packer.

* * * * *